US012723210B2

(12) United States Patent
Rautio et al.

(10) Patent No.: US 12,723,210 B2
(45) Date of Patent: Sep. 1, 2026

(54) METHOD FOR CONVERSION OF CARBON DIOXIDE INTO A FUEL GAS

(71) Applicant: DIMODI ENERGY OY, Helsinki (FI)

(72) Inventors: Antti Rautio, Helsinki (FI); Ligang Tang, Beijing (CN)

(73) Assignee: DIMODI ENERGY OY, Helsinki (FI)

( * ) Notice: Subject to any disclaimer, the term of this patent is extended or adjusted under 35 U.S.C. 154(b) by 36 days.

(21) Appl. No.: 18/839,395

(22) PCT Filed: Feb. 16, 2023

(86) PCT No.: PCT/FI2023/050096
§ 371 (c)(1),
(2) Date: Aug. 16, 2024

(87) PCT Pub. No.: WO2023/156712
PCT Pub. Date: Aug. 24, 2023

(65) Prior Publication Data

US 2025/0154422 A1 May 15, 2025

(30) Foreign Application Priority Data

Feb. 17, 2022 (FI) ..... 20225144

(51) Int. Cl.
*C10L 3/10* (2006.01)

(52) U.S. Cl.
CPC ..... *C10L 3/10* (2013.01); *C10L 2290/02* (2013.01)

(58) Field of Classification Search
CPC ..... C10J 3/00; C10J 2300/0916; C10J 2300/0969; C01B 3/24; C01B 32/40; C01B 3/34; C10L 3/00; C10L 3/10; C10L 2290/02
See application file for complete search history.

(56) References Cited

U.S. PATENT DOCUMENTS

| | | | |
|---|---|---|---|
| 4,040,976 | A | 8/1977 | Greene |
| 2009/0156695 | A1 | 6/2009 | Young |
| 2021/0008496 | A1 | 1/2021 | Hago |

FOREIGN PATENT DOCUMENTS

| | | | | |
|---|---|---|---|---|
| KR | 20210142227 | A * | 11/2021 | ..... C10J 3/66 |
| WO | 2013091878 | A1 | 8/1977 | |
| WO | 2009079681 | A1 | 7/2009 | |
| WO | 2013004391 | A1 | 1/2013 | |

* cited by examiner

*Primary Examiner* — Vishal V Vasisth
(74) *Attorney, Agent, or Firm* — Maschoff Brennan

(57) ABSTRACT

In the method of the invention, carbon dioxide is converted to a fuel gas. The method comprises the steps of feeding carbon dioxide, alkane, and carbon into a rector (3) and heating the reactor (3) to a temperature for pyrolysis to take place. A fuel gas containing carbon monoxide, hydrogen, and methane, is obtained as a reaction product, which is recovered in a gas container.

3 Claims, 1 Drawing Sheet

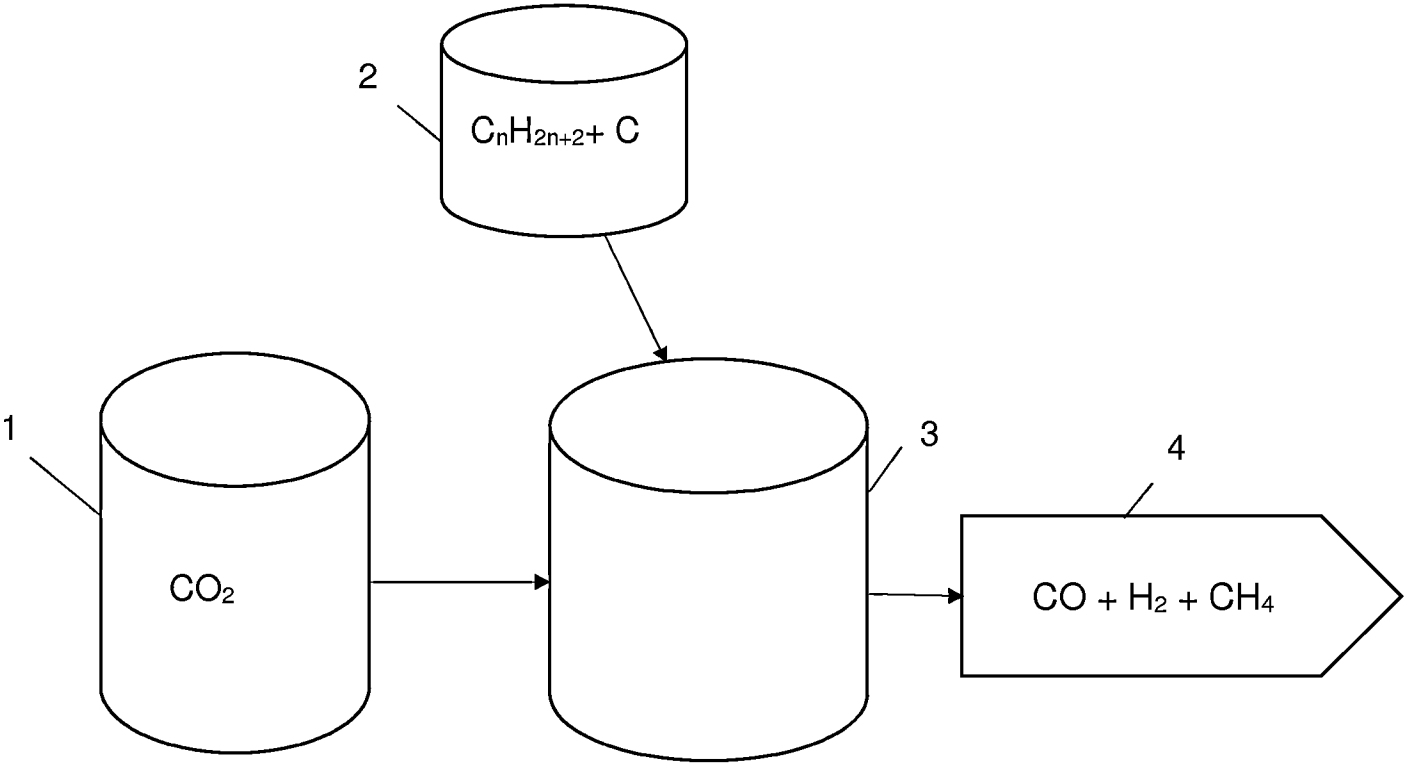
1
$CO_2$
2
$C_nH_{2n+2}$+ C
3
4
$CO + H_2 + CH_4$

METHOD FOR CONVERSION OF CARBON DIOXIDE INTO A FUEL GAS

This application is a 371 of PCT/FI2023/050096, filed Feb. 16, 2023

TECHNICAL FIELD

The invention is concerned with a method for the conversion of carbon dioxide into a fuel gas.

BACKGROUND

Recovery and utility of carbon dioxide are important for the deceleration of climate change. The proportion of carbon dioxide in the atmosphere has increased from having been 320 ppm in the seventies up to 420 ppm today, the main reason being the emission of fossil fuels into the atmosphere.

New methods for the recovery and utility of carbon dioxide have therefore been developed but most of them are still in the stage of research.

One type of those methods is the conversion of carbon dioxide into fuel gas, but they are not economically profitable being up to twice as expensive as other methods for producing electricity.

These methods for producing fuel gas are, however, interesting, not only because the availability of renewable synthetic fuels would decrease the dependence on fossil fuels, but there is a lot of available carbon dioxide to be taken from the industry or directly from the atmosphere, and it is easy to handle. The carbon dioxide molecule is, however, very stable being chemically inert, and its reactions are very energy-consuming.

Different methods for the conversion of carbon dioxide into synthetic fuel gas exist, such as producing methane biologically or catalytically or by conversion of carbon dioxide and hydrogen to synthetic gas and thereafter producing hydrogen carbons with the Fischer-Tropsch method.

All these methods are, however, very energy-consuming in that they require a separate production of hydrogen for example by electrolysis, which also is very expensive to carry out. This far, also the production plants for producing the synthetic gas are energy consuming.

The object of the invention is an improved method to produce fuel gas from carbon dioxide.

SUMMARY

The method of the invention for conversion of carbon dioxide to a fuel gas comprises the steps of feeding carbon dioxide, an alkane, and carbon as reactants into a rector, heating the reactor into a temperature for pyrolysis to take place, whereby a fuel gas containing carbon monoxide, hydrogen, and methane, is obtained as a reaction product.

The preferable embodiments of the invention have the characteristics of the sub-claims.

Thus, the alkane used for the pyrolysis is preferably octacosane, which is a paraffin hydrocarbon $C_{28}H_{58}$.

The chemical compounds involved are thus carbon dioxide, octacosane, and carbon, preferably biocarbon, fed as input and carbon monoxide, hydrogen, and methane obtained as output:

$$CO_2+(C_{28}H_{58}+C)\rightarrow CO+H_2+CH_4$$

The heating of the reactor is performed at a temperature of 700° C.-1000° C., preferably 700° C.-800° C.

When the temperature has been raised to about 400° C., the disintegration of reactants starts, in other words, the gas production starts and continues as long as carbon dioxide is fed, as well as a mix of alkane and carbon in the corresponding proportion, i.e. 1.5-2% of alkane and carbon in relation to the carbon dioxide.

The method has been carried out in our experiment e.g. by adding 10 g biocarbon (C) and 5 ml octacosane ($C_{28}H_{58}$) for each kg of carbon dioxide ($CO_2$). In tests performed, 10 kg of $CO_2$ produced 10 $m^3$ of fuel gas in one hour at a normal pressure The reactor used was a cast iron container with an electrical resistance of 2 KW or a graphite container with another heating resource. The recovery of the fuel gas production takes place in an intermediate gas container at a pressure of 1 MPa.

Methane ($CH_4$) has several advantages as a fuel when compared to hydrogen and there is a demand for it since it is already used as a fuel, such as for cars. Neither is methane explosive, like hydrogen gas ($H_2$), and it is easier to store.

The fuel gas obtained from the methane is a mixture of carbon monoxide (CO), hydrogen ($H_2$), and methane ($CH_4$). The hydrogen can be separated from the obtained fuel gas if desired.

A performed example of the method of the invention are presented in the following.

EXAMPLE

Carbon dioxide ($CO_2$) was fed from a gas bottle into a reactor heated to a temperature of 700° C. with a feed rate of 10 kg per hour.

A mix of 50 g of liquid octacosane and 100 g of carbon was prepared by means of a mixer.

The mix of 150 g of the mix of 50 g octacosane ($C_{28}H_{58}$) and 100 g of biocarbon (C) was fed as a mix from a container into the same reactor by means of a screw charger. The proportions of the carbon dioxide were 1 kg $CO_2$ per 15 g of said mix.

After a reaction time of 1 h, a reaction product of fuel gas that contained carbon monoxide (CO), hydrogen ($H_2$), and methane ($CH_4$) was recovered in a gas container. Thereafter it can be fed for producing electricity for e.g. a gas turbine.

At recovery, the produced fuel gas burns with a flame with a colour that varies from red to blue depending on the reaction temperature. Since $CO_2$ has a cooling effect, the reaction temperature might somewhat vary but in ideal conditions in a temperature of 700-800° C., the fuel gas is pure and the colour of the flame turns blue.

The colour of the flame depends on the purity of the gas—if there is much dust contained, the flame is reddish—with a small amount of dust, the flame is bluish.

In the following the invention is described by means of a referable embodiment by referring to a FIGURE.

FIGURE

The FIGURE is a schematic view of the reaction plant used in the method of the invention.

DETAILED DESCRIPTION

FIG. 1 is a schematic view of the reaction plant used in the method of the invention.

In the method of the invention, carbon dioxide is converted to a fuel gas by feeding carbon dioxide ($CO_2$) from a container or tank 1 to a reactor 3, which has been heated to a temperature over 700° C., sufficient for pyrolysis to take place between the reactants.

An alkane $C_nH_{2n+2}$, preferably octacosane ($C_{28}H_{58}$), is fed mixed together with biocarbon (C) from another container 2 having a mixer into the same reactor 3.

A fuel gas containing carbon monoxide (CO), hydrogen ($H_2$), and methane ($CH_4$), is obtained as a reaction product, which is recovered in a gas container 4.

The preferable embodiments of the invention have the characteristics of the sub-claims.

Thus, the alkane used for the pyrolysis is preferably octacosane, which is a solid paraffin hydrocarbon $C_{28}H_{28}$.

The invention claimed is:

1. A method of converting carbon dioxide to a fuel gas, the method comprising the steps of feeding carbon dioxide, an alkane, and carbon into a reactor, heating the reactor to a temperature of 700° C.-1000° C. for pyrolysis to take place, whereby a fuel gas containing carbon monoxide, hydrogen, and methane is obtained as a reaction product, and wherein the alkane is octacosane and the carbon is biocarbon.

2. The method of claim 1, wherein said carbon dioxide ($CO_2$) is fed from one container or tank to the reactor, and said alkane is mixed together with biocarbon (C) from another container having a mixer into the same reactor.

3. The method of claim 1, wherein said carbon dioxide is fed from one container or tank to the reactor, and said alkane is mixed together with biocarbon from another container having a mixer into the same reactor.

* * * * *